US008756951B2

(12) United States Patent
Bortoletto et al.

(10) Patent No.: US 8,756,951 B2
(45) Date of Patent: Jun. 24, 2014

(54) VERTICAL ICE MAKER PRODUCING CLEAR ICE PIECES

(75) Inventors: Anderson Bortoletto, Waunakee, WI (US); Nihat Cur, Saint Joseph, MI (US); Douglas D. Leclear, Benton Harbor, MI (US); Andrew M. Tenbarge, Saint Joseph, MI (US); Ronald L. Voglewede, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 263 days.

(21) Appl. No.: 13/166,085

(22) Filed: Jun. 22, 2011

(65) Prior Publication Data

US 2012/0324915 A1 Dec. 27, 2012

(51) Int. Cl.
*F25C 5/18* (2006.01)
*F25C 1/00* (2006.01)

(52) U.S. Cl.
USPC ..... 62/344; 62/347; 62/348

(58) Field of Classification Search
USPC ..... 62/344, 347, 348, 74
See application file for complete search history.

(56) References Cited

U.S. PATENT DOCUMENTS

| | | | | |
|---|---|---|---|---|
| 1,825,698 | A | | 10/1931 | King |
| 2,349,367 | A | | 5/1944 | Muffly |
| 3,380,261 | A | | 4/1968 | Hendrix et al. |
| 3,418,823 | A | | 12/1968 | Salimbeni Vivai |
| 3,433,030 | A | | 3/1969 | Jacobs |
| 3,526,100 | A | | 9/1970 | Briel |
| 3,657,899 | A | * | 4/1972 | Hosoda et al. ..... 62/137 |
| 4,184,339 | A | * | 1/1980 | Wessa ..... 62/68 |
| 4,199,956 | A | | 4/1980 | Lunde |
| 4,207,750 | A | | 6/1980 | Simkens |
| 4,452,049 | A | * | 6/1984 | Nelson ..... 62/74 |
| 4,580,410 | A | * | 4/1986 | Toya ..... 62/347 |
| 4,688,386 | A | * | 8/1987 | Lane et al. ..... 62/72 |
| 4,869,067 | A | * | 9/1989 | Sears ..... 60/645 |
| 4,896,800 | A | | 1/1990 | Corey |
| 5,032,157 | A | | 7/1991 | Ruff |
| 5,187,948 | A | | 2/1993 | Frohbieter |
| 5,207,761 | A | | 5/1993 | Ruff |
| 5,212,957 | A | * | 5/1993 | Ruff ..... 62/124 |
| 5,272,884 | A | | 12/1993 | Cur et al. |
| 5,297,394 | A | | 3/1994 | Frohbieter et al. |
| 5,375,432 | A | | 12/1994 | Cur |
| 5,425,243 | A | | 6/1995 | Sanuki et al. |

(Continued)

FOREIGN PATENT DOCUMENTS

| | | |
|---|---|---|
| EP | 0227611 A1 | 7/1987 |
| EP | 0580950 A1 | 2/1994 |

(Continued)

*Primary Examiner* — Cassey D Bauer
*Assistant Examiner* — Steve Tanenbaum

(57) ABSTRACT

An ice making assembly and method utilizes a housing having an upper fluid chamber, a plurality of distinct, substantially vertical fluid channels, and at least one drain aperture in fluid communication with a fluid reservoir. Ice forming members extend from an ice forming evaporator into respective fluid channels. During an ice making event, fluid continuously supplied to the upper fluid chamber flows into each of the fluid channels and out through at least one drain aperture into a fluid reservoir below. The ice forming members are cooled such that fluid flowing across the fluid channels freezes on the ice forming members over time, forming clear ice pieces. The ice pieces are subsequently released from the ice forming members and transferred for storage and/or dispensing.

22 Claims, 5 Drawing Sheets

(56) References Cited

U.S. PATENT DOCUMENTS

| | | | | |
|---|---|---|---|---|
| 5,987,900 | A | 11/1999 | Love | |
| 6,000,228 | A * | 12/1999 | Johnson et al. | 62/73 |
| 6,109,055 | A * | 8/2000 | Kato et al. | 62/347 |
| 6,324,863 | B1 * | 12/2001 | Henry | 62/347 |
| 6,484,530 | B1 * | 11/2002 | Hibino et al. | 62/347 |
| 6,508,075 | B1 * | 1/2003 | Shipley et al. | 62/347 |
| 6,647,739 | B1 | 11/2003 | Kim et al. | |
| 6,688,130 | B1 | 2/2004 | Kim | |
| 6,688,131 | B1 | 2/2004 | Kim et al. | |
| 6,742,351 | B2 | 6/2004 | Kim et al. | |
| 6,907,744 | B2 | 6/2005 | Miller et al. | |
| 6,952,937 | B2 * | 10/2005 | Choi et al. | 62/347 |
| 7,010,933 | B2 * | 3/2006 | Ishitomi et al. | 62/347 |
| 7,062,936 | B2 | 6/2006 | Rand et al. | |
| 7,082,782 | B2 | 8/2006 | Schlosser et al. | |
| 7,201,015 | B2 * | 4/2007 | Feldman et al. | 62/347 |
| 7,437,885 | B2 * | 10/2008 | Wu et al. | 62/344 |
| 7,587,905 | B2 | 9/2009 | Kopf | |
| 7,587,910 | B2 * | 9/2009 | Bowen et al. | 62/389 |
| 2004/0255606 | A1 | 12/2004 | Hornung | |
| 2009/0260371 | A1 | 10/2009 | Kuehl et al. | |
| 2009/0293508 | A1 | 12/2009 | Rafalovich et al. | |
| 2011/0042047 | A1 * | 2/2011 | Karl et al. | 165/115 |

FOREIGN PATENT DOCUMENTS

| | | | |
|---|---|---|---|
| EP | 0580952 | A1 | 2/1994 |
| EP | 0736738 | A2 | 10/1996 |
| GB | 2189016 | A | 10/1987 |

* cited by examiner

VERTICAL ICE MAKER PRODUCING CLEAR ICE PIECES

BACKGROUND OF THE INVENTION

1. Field of the Invention

The present invention pertains to the art of refrigerators and, more particularly, to ice makers for producing clear ice pieces.

2. Description of the Related Art

In general, ice pieces produced with standard ice makers tend to include air bubbles or other imperfections that lend a cloudy or impure appearance to the ice. Therefore, there has been an interest in constructing ice makers which produce clear ice pieces. One approach to preventing the formation of cloudy ice is to agitate or move water in an ice tray during the freezing process. For example, U.S. Pat. No. 4,199,956 teaches an ice making method wherein a plurality of freezing elements are immersed in a pan of water which is agitated by a plurality of paddles during a freezing process. This type of ice maker requires water to be added to the pan every new freezing cycle, and may lead to minerals or other impurities concentrating or collecting in the pan over time. Another approach utilizes the continuous flow of water over a vertical ice-forming plate in a refrigerator compartment to produce ice having a higher purity then that of the original tap water. Specifically, multiple spaced points located on the vertical ice-forming plate are in contact with an evaporator line such that water flowing over the spaced points freezes in layers over time, gradually forming a plurality of ice pieces. In order to harvest the ice pieces, hot refrigerant gas flows into the evaporator line, the warming effect detaches the ice pieces from the ice-forming plate, and the ice pieces fall into an ice bin within the refrigerator compartment. However, large spaces must be left between the contact points of the evaporator in order to prevent ice bridges from developing between ice pieces, thus requiring either relatively large quantities of water to flow over the multiple spaced points, or fewer spaced points. Additionally, this system utilizes the refrigerator's main evaporator, thus requiring the icemaker system to be configured around the location of the main evaporator. Further, ice pieces collected in the ice bin melt over time, which results in diminished ice quality.

Regardless of these known prior art arrangements, there is seen to be a need in the art for an improved ice maker that can be utilized with various refrigerator configurations and produce high quality clear ice pieces utilizing minimal amounts of water.

SUMMARY OF THE INVENTION

The present invention is directed to an ice making assembly and method for a refrigerator which utilizes an ice maker including an upper fluid chamber which supplies fluid to a plurality of distinct, substantially vertical, fluid channels. Ice forming members of an evaporator extend into the substantially vertical fluid channels and are cooled by communication with the refrigerant circulation system of the refrigerator. During an ice making cycle, fluid is continuously supplied to the upper fluid chamber, resulting in streams or sheets of fluid flowing through each of the substantially vertical fluid channels and cascading over the ice forming members therein. Fluid contacting the ice forming members freezes, forming clear ice pieces based on the shape of the ice forming members. The remaining cascades of fluid drain through at least one drain aperture located in the icemaker housing, and into a fluid reservoir below. A pump is utilized to recirculate fluid from the fluid reservoir to the upper fluid chamber.

During an ice harvest event, the ice forming members are heated to release ice pieces formed thereon, and the ice pieces are released from the ice maker. In a preferred embodiment, the ice maker is located with a fresh food compartment of the refrigerator. After ice pieces are released from the ice maker, they are transferred from the fresh food compartment to an ice storage bucket located in a freezer compartment of the refrigerator. After a predetermined period of time or after a predetermined number of ice making cycles, fluid from within the fluid reservoir is drained and a fresh supply of fluid is added to the ice forming apparatus.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
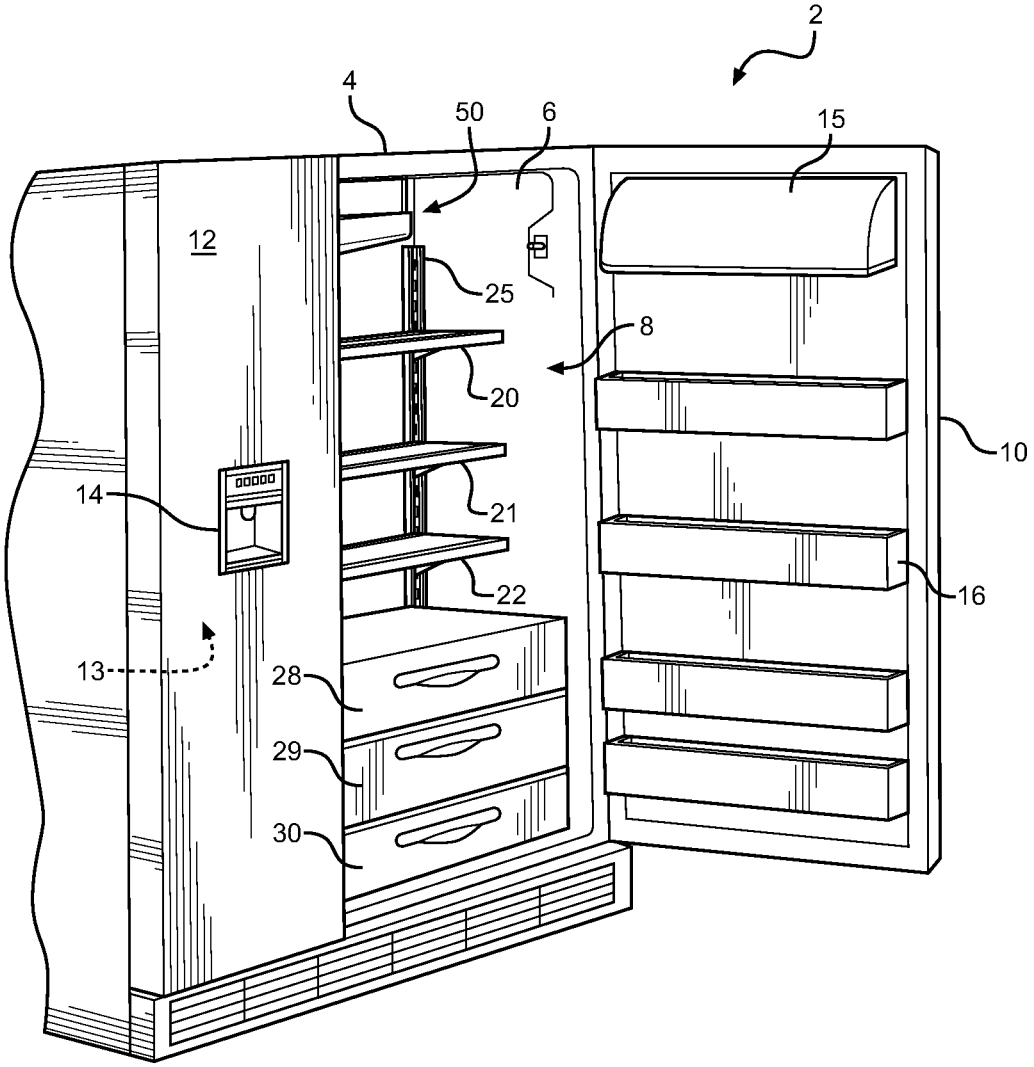
FIG. 1 is a perspective view of a refrigerator including an ice making assembly of the present invention.

With initial reference to FIG. 1, a refrigerator 2 includes an outer shell or cabinet 4 within which is positioned a liner 6 that defines a fresh food compartment 8. In a manner known in the art, fresh food compartment 8 can be accessed by the selective opening of a fresh food door 10. In a similar manner, a freezer door 12 can be opened to access a freezer compartment 13. In the embodiment shown, freezer door 12 includes a dispenser 14 that enables a consumer to retrieve ice and/or fresh water without accessing fresh food or freezer compartments 8 and 13. For the sake of completeness, door 10 of refrigerator 2 is shown to include a dairy compartment 15 and various vertically adjustable shelving units, one of which is indicated at 16.

In a manner known in the art, fresh food compartment 8 is provided with a plurality of vertically, height adjustable shelves 20-22 supported by a pair of shelf support rails, one of which is indicated at 25. At a lowermost portion of fresh food compartment 8 is illustrated various vertically spaced bins 28-30. At this point, it should be recognized that the above described refrigerator structure is known in the art and presented only for the sake of completeness. The present invention is not limited for use with a side-by-side style refrigerator shown, but may be utilized with other known refrigerator styles including top-mount, bottom-mount, or French door style refrigerators. Instead, the present invention is particularly directed to a clear ice making assembly which is generally indicated at 50.

Figure 2:
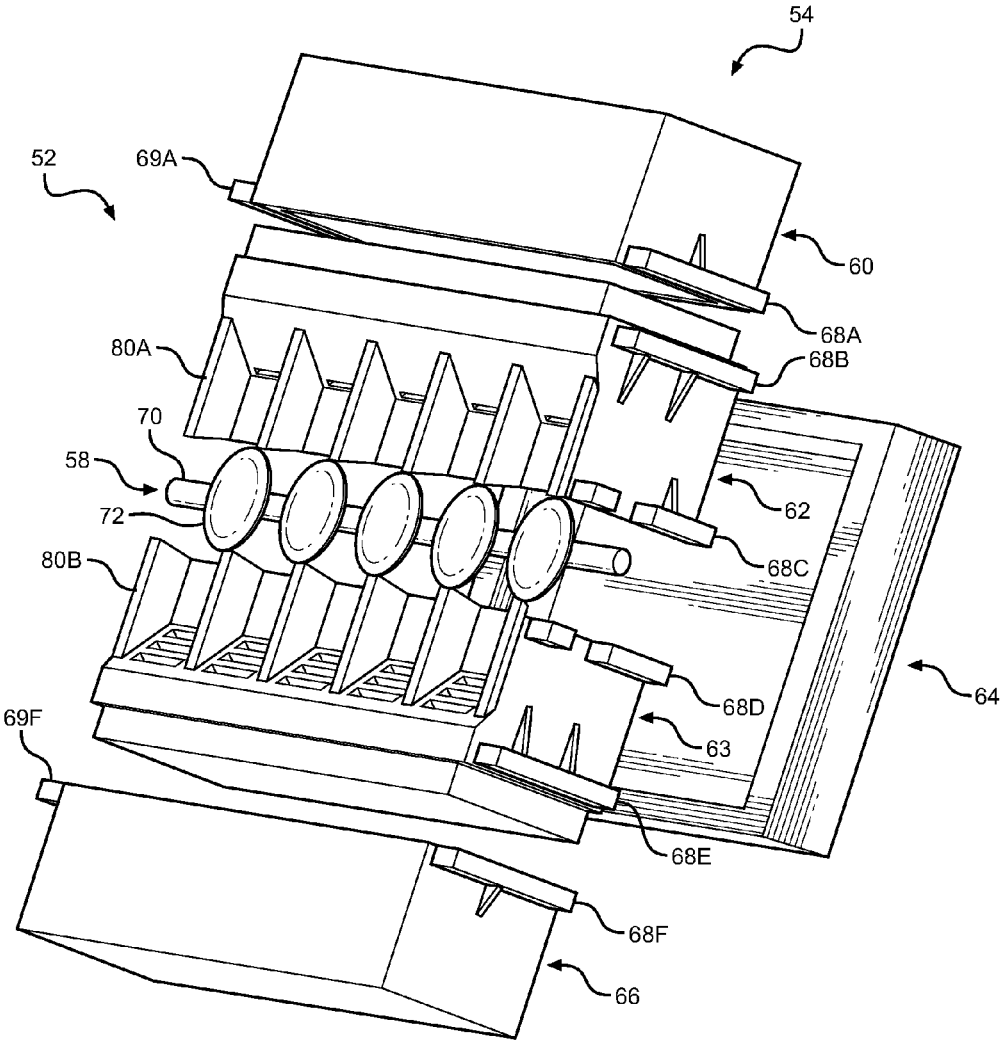
FIG. 2 is an exploded view of an ice making assembly of the present invention.

Details of an ice maker 52 utilized in clear ice making assembly 50 will now be discussed with reference to FIG. 2. In general, ice maker 52 includes a housing 54 and an ice forming evaporator member 58. In the preferred embodiment depicted, housing 54 includes a top cover 60, first and second fluid channeling portions 62 and 63, a back plate 64 and a bottom fluid recycling portion 66. Ice forming evaporator member 58 includes a refrigerant line 70 and a plurality of ice forming members 72 extending there from. In the preferred embodiment shown, ice forming members 72 are in the form of discs or buttons, however, ice forming members 72 could take other shapes, such as rectangles or ovals, depending on the shape of the ice pieces desired.

During assembly of ice maker 52, ice forming evaporator member 58 is sandwiched between first and second fluid channeling portions 62 and 63. Back plate 64, which is preferably constructed of an insulating material, such as foam, plastic or the like, is fit within the first and second fluid channeling portions 62 and 63 before top cover 60 and bottom fluid recycling portion 66 are connected to the first and second fluid channeling portions 62 and 63 to form a complete housing 54. More specifically, first and second fluid channeling portions 62 and 63 are snap-fit or otherwise mechanically connected together through flanges 68A-68F and 69A-69F (shown in FIG. 3) extending from opposing sides of the top cover 60, first and second fluid channeling portions 62 and 63 and bottom fluid recycling portion 66, to enclose refrigerant line 70 there between. When fit together, a plurality of vertically aligned divider plates 80A extending from the first fluid channeling portion 62 align with a plurality of vertically aligned divider plates 80B on the second fluid channeling portion 63 to form a plurality of channel walls 82A-82F as depicted in FIG. 3.

Between adjacent ones of channel walls 82A-82F are spaced, distinct and substantially vertical fluid channels 84A-84E, with one ice forming member 72 extending into a respective one of the multiple vertical fluid channels 84A-84E. Each vertical fluid channel 84A-84E includes at least one drain aperture 86A-86E formed in a sloped front face portion 87 of second fluid channeling portion 63, with each of the drain apertures 86A-86E being in fluid communication with a fluid reservoir 88 defined by bottom fluid recycling portion 66 (see FIG. 4). A drain conduit 89 extending from recycling portion 66 is adapted to drain fluid from recycling portion 66 as discussed in more detail below.

Figure 3:
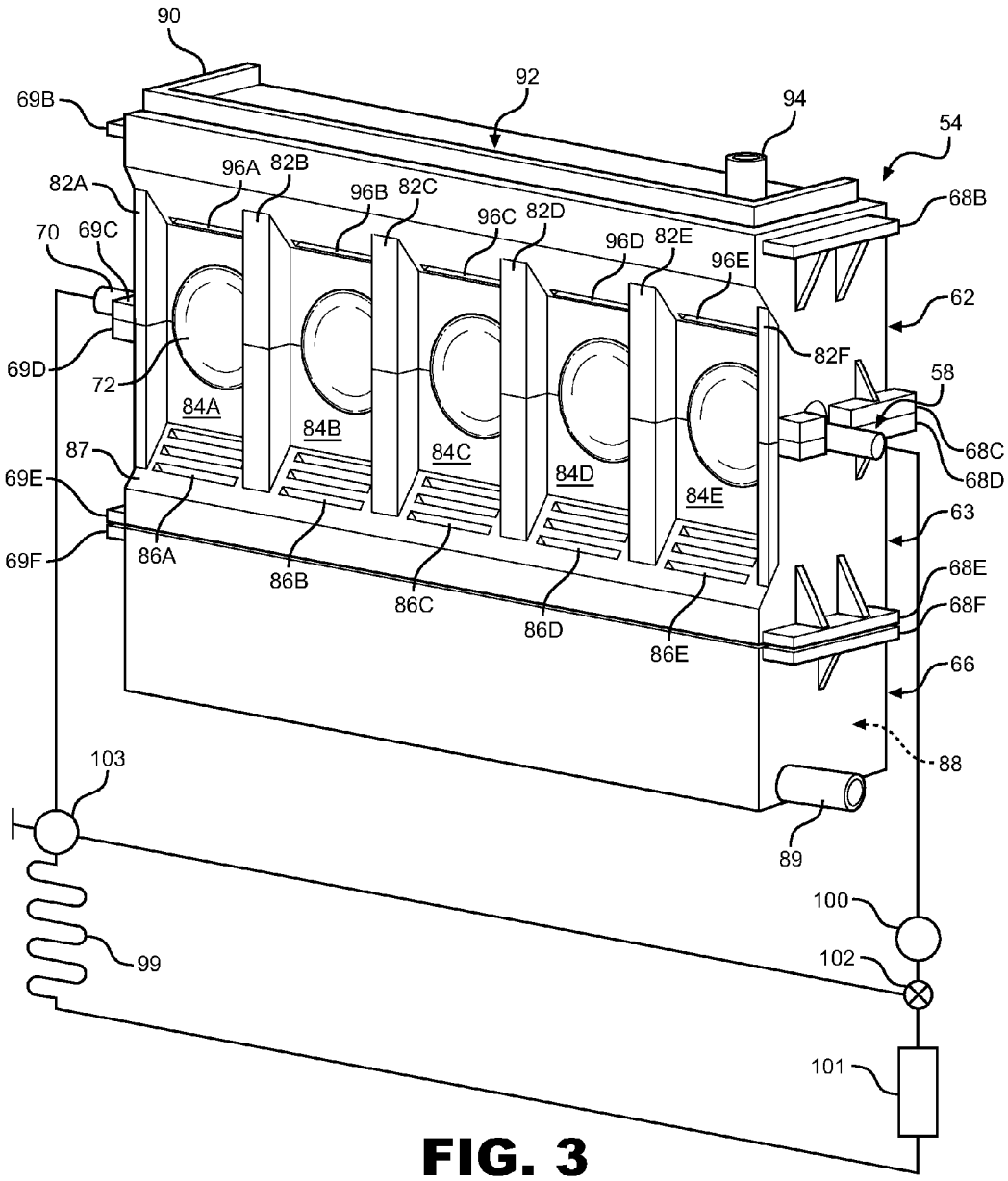
FIG. 3 is a partial perspective view of the ice maker of FIG. 2.
Figure 4:
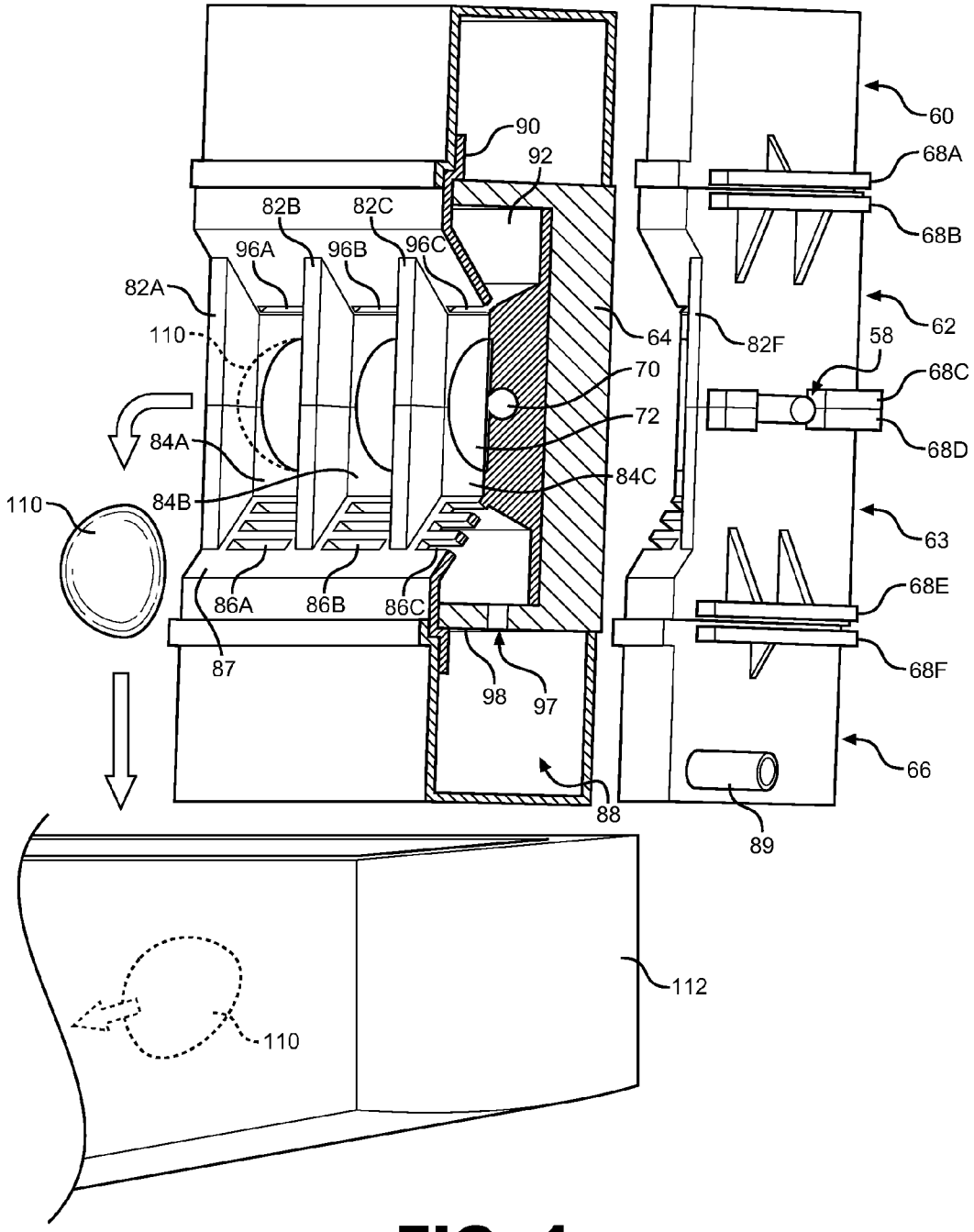
FIG. 4 is a partial cross-sectional side view of the ice maker of FIG. 2.

As best shown in FIGS. 3 and 4, housing 54 includes a plurality of upstanding side walls 90 that define a fluid channel 92 (FIG. 4) extending along the length of ice maker 52. A fluid inlet 94 (FIG. 3) supplies fluid to fluid channel 92 upon initiation of an ice making cycle. Various methods of initiating an ice making cycle are known in the art, including providing a controller for initiating an ice making cycle based on the amount of ice stored within an ice bucket. In accordance with the present invention, a known method of initiating an ice making cycle may be utilized, and such details are not considered to be part of the present invention. Instead, the invention is particularly directed to the structure of clear ice making assembly 50 and the manner in which ice pieces are produced and dispensed, which will now be discussed with reference to FIGS. 3 and 4.

Upon initiation of an ice making event, water is continuously supplied to top fluid channel 92 via fluid inlet 94. Water fills upper fluid chamber 92 and flows downward into respective fluid channels 84A-84E through fluid inlet apertures 96A-96E formed in housing 54. As shown, fluid inlet apertures 96A-96E are preferably in the form of narrow, elongated slots. Streams or sheets of water flow vertically through each of the respective vertical fluid channels 84A-84E and across ice forming members 72, with any of the fluid which reaches drain apertures 86A-86E draining through an opening 97 in a bottom wall 98 of back plate 64 to enter fluid recycling portion 66. Fluid inlet apertures 96A-96E are preferably centered above respective ice forming members 72 such that fluid streams cascade over the entire face of ice forming members 72 before entering fluid reservoir 88. As depicted in FIG. 3, a refrigerant circulation system of refrigerator 2 is in fluid communication with ice forming evaporator member 58. More specifically, cooled refrigerant from a refrigerator evaporator 99 flows through refrigerant line 70 of ice forming evaporator member 58. After passing through ice forming evaporator member 58, the refrigerant circulates through a compressor 100 and condenser 101 before circulating back through refrigerator evaporator 99 to start the cycle anew.

In accordance with the present invention, ice forming members 72 are preferably chilled through direct contact with refrigerant, such as the flow of refrigerant through hollow portions (not shown) of ice forming members 72, or ice forming members 72 may be chilled through indirect contact with refrigerant flowing through refrigerant line 70 (i.e., via conduction). In any event, fluid streams flowing through vertical fluid channels 84A-84E will flow over chilled ice forming members 72, preferably in a laminar fashion, resulting in the continuous formation of successive, thin ice layers on the chilled ice forming members 72, which build up over time to form clear ice pieces. Advantageously, such thin ice layers prevent air bubbles from forming, and the constant flow of water over the forming ice pieces "cleans" the ice pieces as they form, enabling the formation of clear ice pieces without air bubbles and cloudiness associated with the formation of standard ice pieces. In a preferred embodiment, ice forming evaporator member 58 is formed from a material having high thermal conductivity, such as copper, and first and second fluid channeling portions 62 and 63 are formed from a plastic material having a lower thermal conductivity than ice forming evaporator member 58. Alternatively, or in addition, first and second fluid channeling portions 62 and 63 could be provided with a phobic or hydrophobic coating. With this configuration, ice only forms on ice forming members 72 during an ice production cycle, thereby forming clear and distinctly shaped individual ice pieces without any undesirable bridging between the ice pieces.

After a predetermined amount of time, or based on another known method for determining the end of an ice production cycle, ice forming members 72 are heated to melt the portions of the ice pieces in direct contact with chilled ice forming members 72 in order to release the ice pieces from the ice forming members 72. Heating of ice forming members 72 may be accomplished through the use of a heating element, such as an electric resistive heating element in heating relationship with ice forming members 72, or through the use of gaseous refrigerant, which is circulated through ice forming evaporator member 58. Preferably, one or more valves indicated at 102 and 103 (FIG. 3) is/are actuated to direct heated refrigerant gas from compressor 100 directly to ice forming evaporator member 58 in order to heat ice forming members 72 during an ice harvesting cycle. Such harvesting methods are known in the art and, therefore, will not be discussed in detail herein. See, for example, U.S. Pat. Nos. 5,212,957 and 7,587,905. In addition, other ice releasing arrangements could be employed, including the use of ice phobic technology, an electrical charge, a secondary heater and the like.

Figure 5:
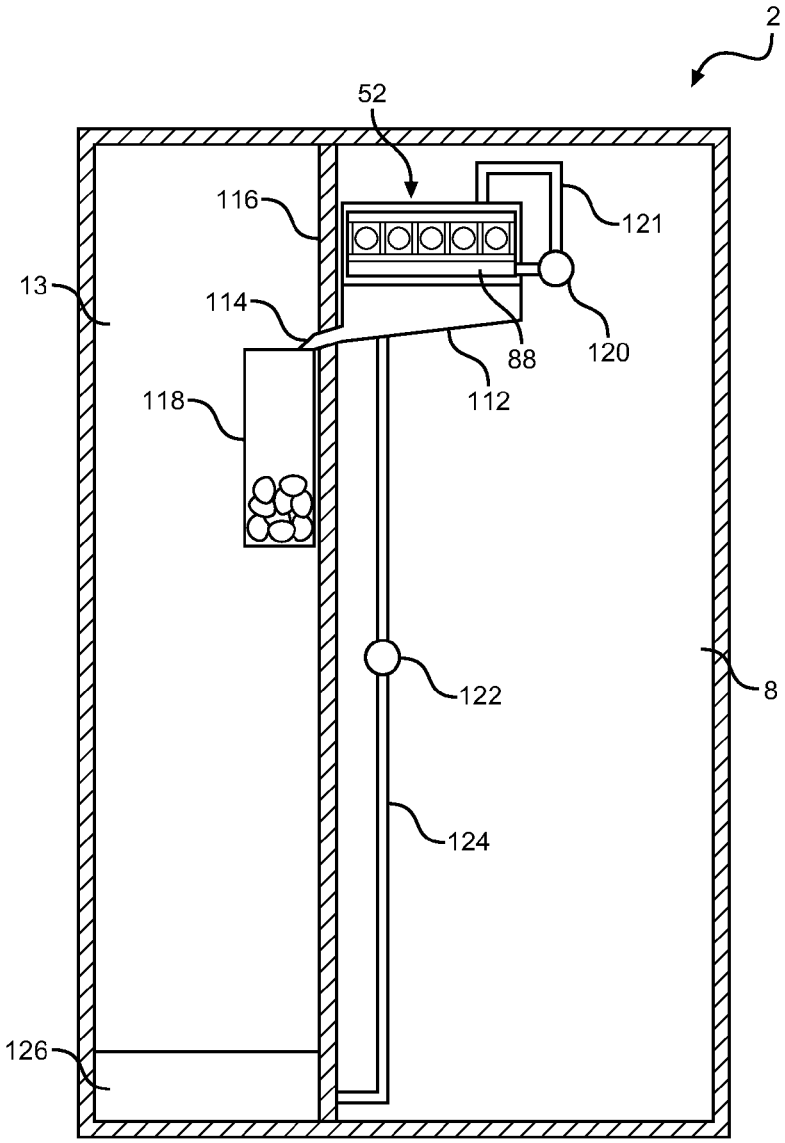
FIG. 5 depicts a fluid circulation system utilized in the present invention.

As depicted in FIG. 4, ice pieces 110 released from ice forming members 72 will be guided by channel walls 82A-82F and a sloped front face portion 87 toward a storage container. More specifically, in a preferred embodiment depicted in FIGS. 4 and 5, ice released from ice forming members 72 will be deflected by sloped front face portion 87 into an ice transfer chute 112, where the ice pieces 110 will be guided through an aperture 114 located in an insulated wall 116 separating the fresh food and freezer compartments 8 and 13, and into an ice storage bucket 118 located in the freezer compartment 13. During the ice forming event, water collected in fluid reservoir 88 is preferably continuously pumped back into upper fluid chamber 92 via an inlet pump 120 and recirculation line 121. Alternatively, fresh water may be supplied to upper fluid chamber 92 for the duration of the ice forming event. At the beginning of a new ice forming event, water from fluid reservoir 88, with or without additional fresh water, may be utilized to continuously supply water to upper fluid chamber 92. Preferably, water from fluid reservoir 88 is recycled a predetermined number of times before a drain valve 122 is actuated, and fluid reservoir 88 is emptied through a drain line 124 to a drain or condensate pan indicated at 126. Fresh fluid is then supplied to the ice forming apparatus, either through the fluid reservoir 88, or directly into upper fluid chamber 92. The combination of upper fluid chamber 92, distinct fluid channels 84A-84E, and the fluid recycling method utilized, allows clear ice making assembly 50 to utilize minimal amounts of fluid in the production of ice pieces, preferably approximately 220 ml per ice-making cycle.

Based on the above, it can be seen that a multi-piece housing fits together about an ice forming evaporator, and defines spaced, distinct, and substantially vertical fluid channels. An upper fluid chamber, also defined by the housing, feeds fluid into each of the fluid channels, causing thin layers of ice to successively form on the ice forming members extending into each of the fluid channels and build up over time to form ice pieces having a desired size and shape. As discussed above, the ice maker of the invention includes its own dedicated ice forming evaporator which is adapted to connect to the refrigerator circulation system of any type of refrigerator unit. With this modular configuration, the ice maker can be placed anywhere within a refrigerator. The result is an ice making system that has a wide range of applications and utilizes minimal amounts of fluid to form clear ice pieces which can be stored in a freezer compartment to prevent wasteful melting of the ice pieces over time.

Although described with reference to preferred embodiments of the invention, it should be readily understood that various changes and/or modifications can be made to the invention without departing from the spirit thereof. For instance, although shown in the form of slots, the drain apertures could be in the form of drain holes, or may be any other type of aperture allowing fluid to drain into the fluid reservoir. In addition, although multiple, horizontally arranged ice forming members are shown, it should be understood that multiple, vertically arranged ice forming members could also be employed. Furthermore, although the invention has been described with reference to the depicted domestic refrigerator, the invention can also be employed in dedicated ice making machines, whether self-contained, under counter or countertop units. Finally, it should also be understood that various arrangements could be utilized to cool the ice forming members. That is, directing refrigerant from the main cooling system of the refrigerator is described in the preferred embodiment, but other cooling systems, such as a secondary refrigerant loop or a Peltier (thermoelectric) cooling arrangement, could be employed. In general, the invention is only intended to be limited by the scope of the following claims.

What is claimed is:

1. A refrigerator comprising:
a cabinet including a fresh food compartment and a freezer compartment;
a cooling system; and
a clear ice making assembly comprising:
a housing defining an upper fluid chamber;
a fluid inlet adapted to supply fluid to the upper fluid chamber;
a plurality of walls that define a plurality of spaced, substantially vertical fluid channels there between, with each of the plurality of fluid channels including a fluid inlet aperture in communication with the upper fluid chamber;
a fluid reservoir;
at least one drain aperture formed below the plurality of fluid channels and in fluid communication with the fluid reservoir; and
a plurality of ice forming members configured to be cooled by the cooling system, wherein each of the plurality of ice forming members extends into and spans less than a full width of a respective one of the plurality of fluid channels such that fluid flowing through the fluid inlet aperture of each of the plurality of fluid channels is directed over the plurality of ice forming members before draining into the fluid reservoir through the at least one drain aperture.

2. The refrigerator of claim 1, wherein the fluid channels are constructed of a material having a lower thermal conductivity than a material of the plurality of ice forming members.

3. The refrigerator of claim 1, wherein the fluid reservoir is in fluid communication with the upper fluid chamber through a fluid recirculation line; and the clear ice making assembly further comprises at least one pump adapted to transfer fluid between the fluid reservoir and the upper fluid chamber.

4. The refrigerator of claim 1, wherein the clear ice making assembly further comprises a drain line adapted to drain fluid from the fluid reservoir.

5. The refrigerator of claim 1, wherein the clear ice making assembly includes first and second fluid channeling portions that fit together about the plurality of ice forming members to form the housing, and wherein the housing further defines the plurality of fluid channels, the fluid inlet apertures and the at least one drain aperture.

6. The refrigerator of claim 1, wherein the clear ice making assembly further comprises:
an ice storage bucket located in the freezer compartment; and
an ice transfer chute located beneath the plurality of fluid channels, wherein at least the plurality of fluid channels and the plurality of ice forming members are located in the fresh food compartment, and the ice transfer chute is adapted to transfer clear ice pieces dispensed from the ice making assembly from the fresh food compartment to the freezer compartment.

7. The refrigerator of claim 1, wherein the at least one drain aperture is formed in a front face portion of the housing which is sloped such that clear ice pieces released from each of the plurality of ice forming members are guided by the plurality of walls and the front face portion for storage within the refrigerator.

8. A clear ice making assembly comprising:
an upper fluid chamber;
a fluid inlet adapted to supply fluid to the upper fluid chamber;
a plurality of walls that define a plurality of spaced, substantially vertical fluid channels there between, with each of the plurality of fluid channels including a fluid inlet aperture in communication with the upper fluid chamber;

a fluid reservoir;

at least one drain aperture located below the plurality of fluid channels and in fluid communication with the fluid reservoir; and a plurality of ice forming members configured to be cooled by a cooling system, wherein each of the plurality of ice forming members extends into and spans less than a full width of a respective one of the plurality of fluid channels such that fluid flowing through the fluid inlet aperture of each of the plurality of fluid channels is directed over the plurality of ice forming members before draining into the fluid reservoir through the at least one drain aperture.

9. The clear ice making assembly of claim 8, wherein the fluid channels are constructed of a material having a lower thermal conductivity than a material of the ice forming members.

10. The clear ice making assembly of claim 8, wherein the fluid reservoir is in fluid communication with the upper fluid chamber through a fluid recirculation line; and the ice making assembly further comprises at least one pump controlling a transfer of fluid between the fluid reservoir and the upper fluid chamber.

11. The clear ice making assembly of claim 8, wherein the ice making assembly further comprises a drain line adapted to drain fluid from the fluid reservoir.

12. The clear ice making assembly of claim 8, further comprising first and second fluid channeling portions that fit together about the plurality of ice forming members to form a housing, wherein the housing defines the upper fluid chamber, the plurality of fluid channels, each fluid inlet aperture and the at least one drain aperture.

13. The clear ice making assembly of claim 8, further comprising:

an ice transfer chute located beneath the plurality of fluid channels, and adapted to transfer clear ice pieces dispensed from the ice making assembly to an ice bucket.

14. The ice making assembly of claim 8, wherein the at least one drain aperture is located in a front face portion of a housing which is sloped such that clear ice pieces released from each of the plurality of ice forming members are guided by the plurality of walls and the front face portion toward an ice transfer chute located below the plurality of fluid channels.

15. A method of forming ice with a clear ice making assembly including a housing having an upper fluid chamber, a plurality of walls that define a plurality of substantially vertical fluid channels there between, and at least one drain aperture in fluid communication with a fluid reservoir, the ice making assembly also including a plurality of ice forming members extending into and spanning less than a full width of a respective one of the plurality of fluid channels, the method comprising:

continuously supplying fluid to the upper fluid chamber such that fluid flows from the upper fluid chamber, through a plurality of fluid inlet apertures, into respective ones of the plurality of fluid channels, across each of the plurality of ice forming members and out through at least one drain aperture of the housing; and cooling the plurality of ice forming members such that clear ice pieces form on the plurality of ice forming members over a period of time.

16. The method of claim 15, wherein the step of continuously supplying fluid to the upper fluid chamber includes pumping fluid from the fluid reservoir through a fluid recirculation line to the upper fluid chamber.

17. The method of claim 15, further comprising:

draining fluid from the fluid reservoir.

18. The method of claim 15, wherein the flow into the plurality of fluid channels is laminar.

19. The method of claim 15, further comprising:

initiating an ice harvesting cycle to release the clear ice pieces from the plurality of ice forming members, wherein the ice harvesting cycle includes transferring the clear ice pieces released from the plurality of ice forming members to an ice storage bucket through an ice transfer chute.

20. The method of claim 19, wherein the housing and the plurality of ice forming members are located within a fresh food compartment of a refrigerator and the ice storage bucket is located in a freezer compartment of the refrigerator, and the ice transfer chute transfers the ice pieces released from the plurality of ice forming members through a wall separating the fresh food and freezer compartments to the ice storage bucket.

21. The refrigerator of claim 1, wherein each of the plurality of ice forming members is spaced from an adjacent one of the plurality of ice forming members by more than a respective one of the plurality of walls.

22. The refrigerator of claim 1, wherein each of the plurality of ice forming members has a curved shape.

* * * * *